United States Patent [19]

Durr et al.

[11] 4,191,339

[45] Mar. 4, 1980

[54] APPARATUS FOR SUPPORTING A REEL OF CABLE FOR ROTATION

[75] Inventors: Helmut E. Durr, Dunwoody; George E. Mock, Duluth, both of Ga.

[73] Assignee: Western Electric Company, Incorporated, New York, N.Y.

[21] Appl. No.: 15,982

[22] Filed: Feb. 28, 1979

[51] Int. Cl.[2] ..... B65H 75/02

[52] U.S. Cl. ..... 242/54 R; 242/66; 242/68.7; 269/289 MR

[58] Field of Search ..... 242/68.7, 78.7, 66, 242/58.6, 79, 54 R, 55; 414/433, 429, DIG. 910, DIG. 911; 269/289 MR, 296

[56] References Cited

U.S. PATENT DOCUMENTS

| | | | |
|---|---|---|---|
| 2,904,273 | 9/1959 | Turner, Jr. et al. | 242/68.7 X |
| 3,073,539 | 1/1963 | Brown | 242/68.7 X |
| 3,198,449 | 8/1965 | Scher | 242/68.7 X |
| 3,695,532 | 10/1972 | Lindstaedt | 242/58.6 X |
| 3,743,205 | 7/1973 | Misrach | 242/68.7 |
| 3,772,635 | 11/1973 | Frey et al. | 339/99 R |

*Primary Examiner*—John M. Jillions
*Attorney, Agent, or Firm*—E. W. Somers

[57] ABSTRACT

An apparatus (20) for supporting rotatably a reel (27) of cable so that it may be turned, for example, to render ends of the cable accessible for connectorization, includes a pair of spaced, parallel cradle rolls (30, 31), which in rest positions are in engagement with a support surface of a base plate (51). A reel is moved so that its flanges are supported on a reference surface (43) which extends between the cradle rolls and which is generally coincident with a factory floor surface that is spaced above the base plate. An actuating member (60, 60') associated with each cradle roll is moved from an unoperated position toward its associated cradle roll to cause wedges (69–69) extending from the actuating member and between the cradle roll and the base plate to cam the cradle roll upwardly along inclined surfaces of the wedges and vertical surfaces of bearing blocks (56—56) adjacent one side of each cradle roll in which passive satellite rollers (53—53) are mounted rotatably. The upward movement of the cradle rolls causes them to engage the flanges of the reel so that as the rolls are moved further upwardly, the reel is moved out of engagement with the reference surface and is supported between the rolls. The upward movement is continued until each cradle roll is supported between its associated passive satellite rollers on the one side and active satellite rollers (66—66) on its other side which are mounted rotatably on the actuating member. After the reel is turned by rotating one of the cradle rolls, a return of the actuating members to their unoperated positions permits the cradle rolls to descend until they occupy their rest positions, at which time the reel rests in engagement with the reference surface so that it can be moved from the apparatus.

10 Claims, 11 Drawing Figures

APPARATUS FOR SUPPORTING A REEL OF CABLE FOR ROTATION

TECHNICAL FIELD

This invention relates to an apparatus for supporting a cylindrically shaped article for rotation, and, more particularly, to an apparatus for supporting and for rotating a reel of cable at a work position to facilitate factory connectorization of ends of the cable.

BACKGROUND OF THE INVENTION

The capability of turning rotatably reels of cable within a factory has assumed increased importance because of a current move toward factory connectorization of cable ends. Once a cable has been connectorized, its ends may be easily spliced to adjacent cables in the field thus avoiding priorly used field splicing procedures which are expensive as well as difficult to perform overhead or within the confines of a manhole. Cables are easily connectorized in a factory setting with multiconductor connectors such as that shown in U.S. Pat. No. 3,772,635, for example, which issued Nov. 13, 1973 in the names of D. R. Frey et al.

In order to connectorize a cable in a factory, a reel having a predetermined length of cable wound thereon is moved into a work position where it usually must be turned rotatably in order for a factory workperson to have access to ends of the cable. Cable handling equipment for turning reels has been used in the past but not to the extent which is required in current connectorization programs. The installation of that equipment has generally required the removal of factory surface flooring such as, for example, wood blocks, as well as a concrete subflooring in order to be able to install footings to support the equipment. Cable handling equipment which is supported above a factory floor and which may be used to turn reels is available commercially, but it is relatively expensive and generally requires the use of auxilliary equipment to lift the loaded reels into a support position in the equipment.

There is a need for an apparatus which is relatively inexpensive and which may be installed in a factory without substantial excavation. Such an apparatus desirably includes a support position into which a reel of cable is rolled thereby avoiding the imposition of unnecessary tasks on motorized material handling equipment within the factory.

SUMMARY OF THE INVENTION

The foregoing problems of the prior art are overcome by an apparatus in accordance with this invention and which includes a pair of parallel rolls which are spaced apart a distance which is less than the diameter of an end section of a cylindrically shaped article to be supported thereon. Means are provided for supporting at least one of the rolls in an unoperated rest position between a first surface and a second surface, which may be spaced apart a distance which is substantially equal to the diameter of said at least one of the rolls, with the cylindrically shaped article being supported in engagement with the second surface between the rolls. The apparatus includes means for causing the at least one roll to be moved from the rest position into engagement with the cylindrical article and then to be further moved into a work position to cause the article to be supported between the rolls above the second surface, said means including means moveable along the first surfaces for causing the at least one roll to be engaged at successively increasing distances above the first surface. When the at least one roll has been moved into the work position, means are rendered effective for supporting the at least one roll for rotation and means support the other roll for rotation so that the cylindrical article is supported rotatably between the rolls.

In a preferred embodiment, the invention includes a pair of spaced cradle rolls which are disposed along parallel axes and which in an unoperated rest position, are in engagement with a plate which may be supported on an existing sub-floor that is exposed by the removal of factory surface flooring such as wood blocks. Each cradle roll is positioned between and at least in proximate engagement with a plurality of associated passive, satellite rollers that are supported along fixed axes of rotation and with wedge-shaped members projecting from actuating members that span across the apparatus parallel to the axes of the cradle rolls. The actuating members, which are connected together along sides of the apparatus, are moved toward the cradle rolls to cause the wedge-shaped members, which are in engagement with lowermost portions of the cradle rolls, to cam up each of the cradle rolls, until each is supported for rotation by the associated passive satellite rollers and active satellite rollers which are mounted rotatably on the actuating members. A reel which has been rolled along the factory surface floor and between the cradle rolls is raised above the factory surface floor and supported by the cradle rolls which are then turned to rotate the reel and expose ends of the cable wound thereon for operations such as, for example, connectorization.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
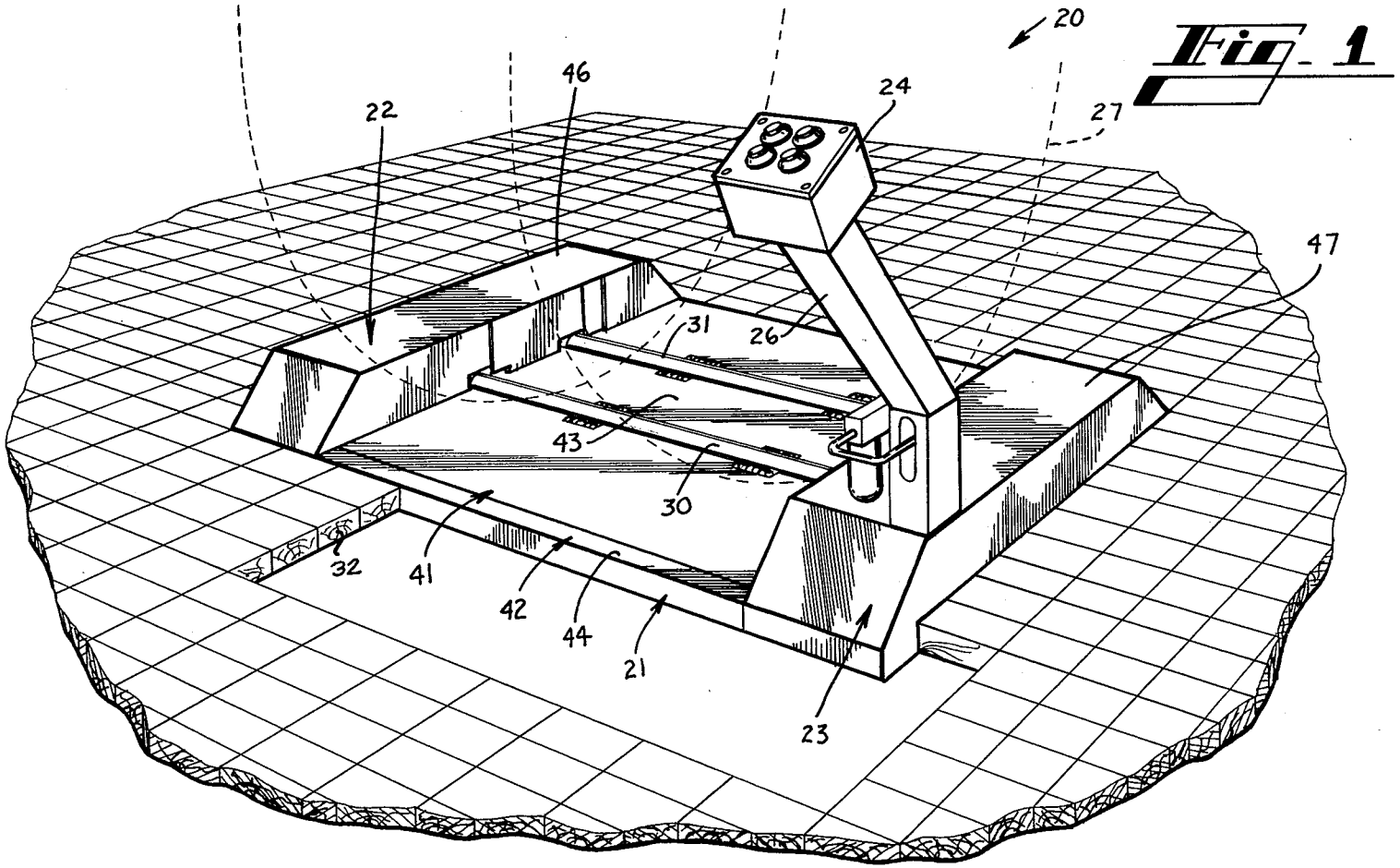
FIG. 1 is an overall perspective view of an apparatus in accordance with this invention for supporting and for rotating a reel of cable.

An overall view of an apparatus, designated generally by the numeral 20, is shown in FIG. 1 and includes a base 21, which extends between two side housings 22 and 23, and a control panel 24 which is mounted on a column 26 that extends from the side housing 23. The apparatus 20 is designed to permit a reel 27 of cable which is to be factory-terminated with a connector system such as that shown in U.S. Pat. No. 3,858,158, which issued Dec. 31, 1974 in the names of R. W. Henn et al, for example, to be supported in a work position between two cradle rolls 30 and 31. In order to facilitate the connectorization of a wide range of reel sizes, the housings 22 and 23 are spaced apart a distance which is sufficient to accommodate the largest flange-to-flange distance that is expected.

As can also be seen in FIG. 1, the base 21 has a depth which is generally equal to the depth of a conventional wood block surface factory floor 32. This correspondence is most advantageous in that only the surface flooring need be removed to install the apparatus 20, thereby avoiding expensive excavation and construction of concrete footings such as has been required in the past.

Referring again to FIG. 1, it is seen that the base 21 includes a cover 41 comprising two end sections 42—42 and a center section 43 with a top surface thereof being generally coincident with the factory floor surface. Each of the end sections 42—42 is formed to facilitate the movement of a reel 27 of cable from the factory floor 32 onto the base 21 and between the cradle rolls 30 and 31.

Figure 2A:
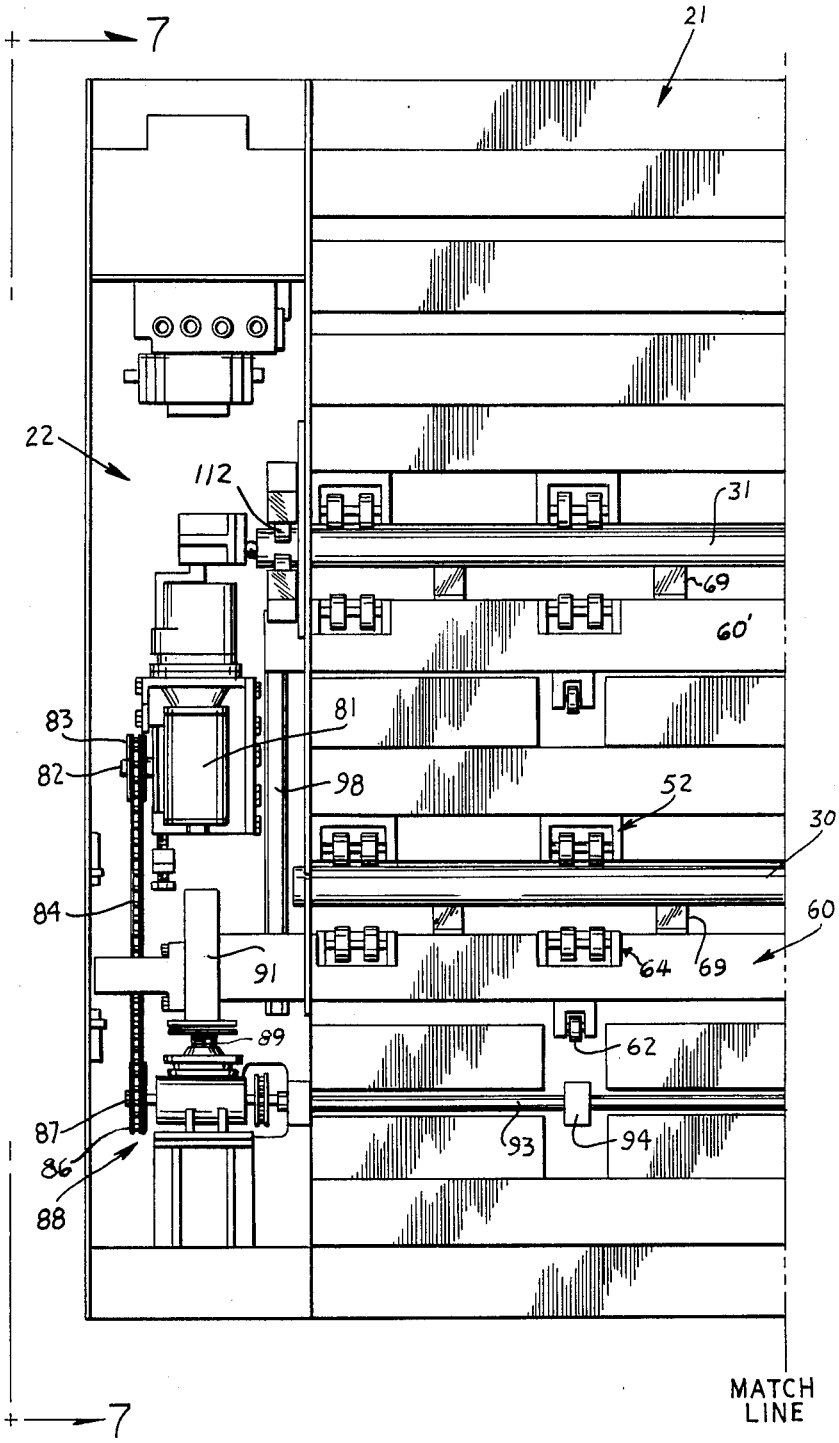
FIGS. 2A and 2B together along the match line provide a plan view of the apparatus of FIG. 1 with top covers thereof removed to expose operating portions of the apparatus.
Figure 2B:
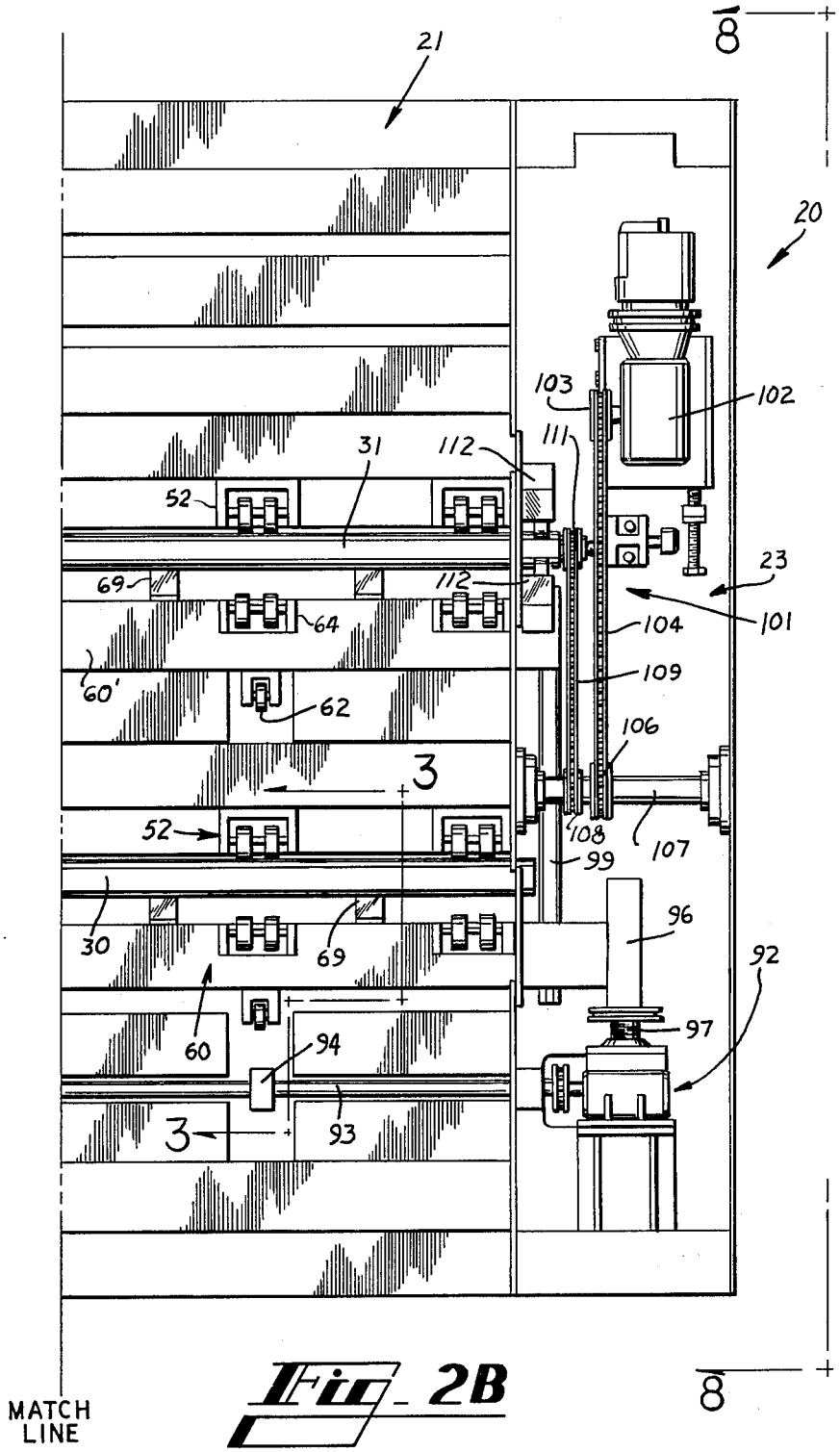
Figure 3:
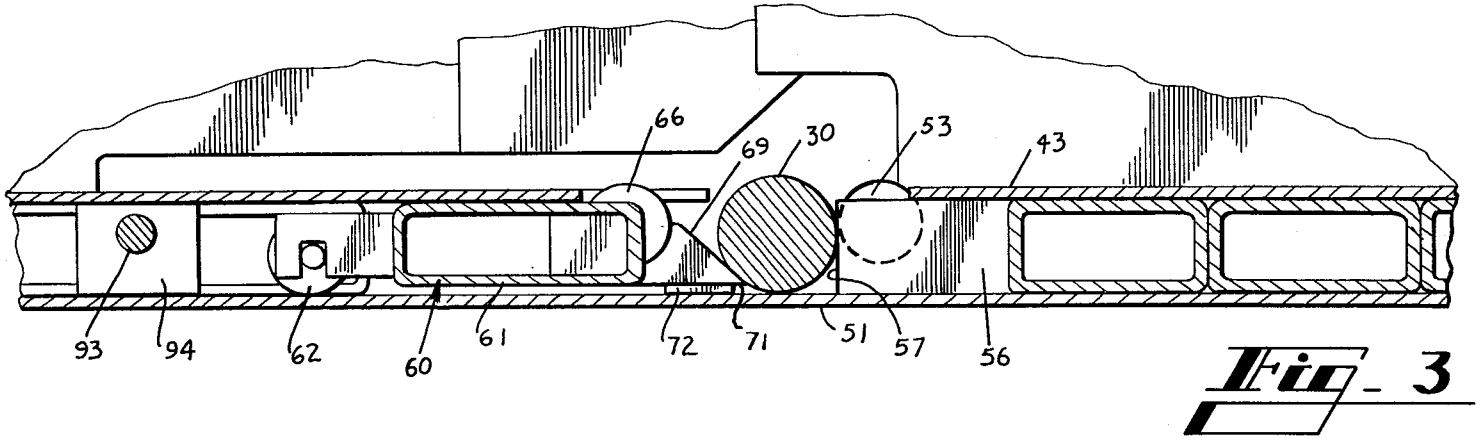
FIG. 3 is an elevational view in section of the apparatus taken along lines 3—3 of FIG. 2 to show one of two cradle rolls in an unoperated rest position.
Figure 4:
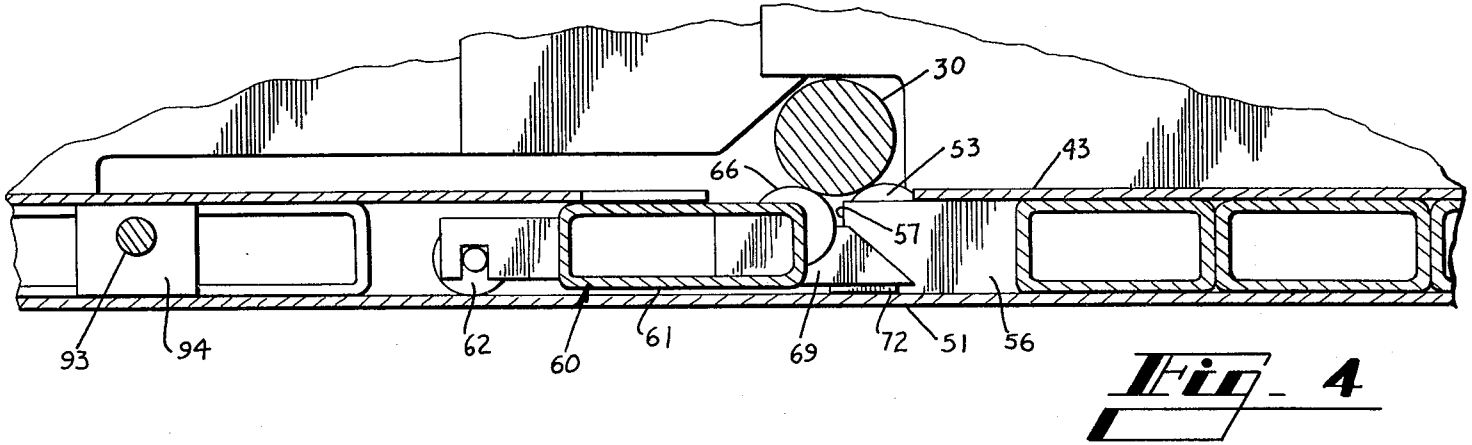
FIG. 4 is a view similar to that of FIG. 3 with the cradle roll in an operated position.
Figure 6:
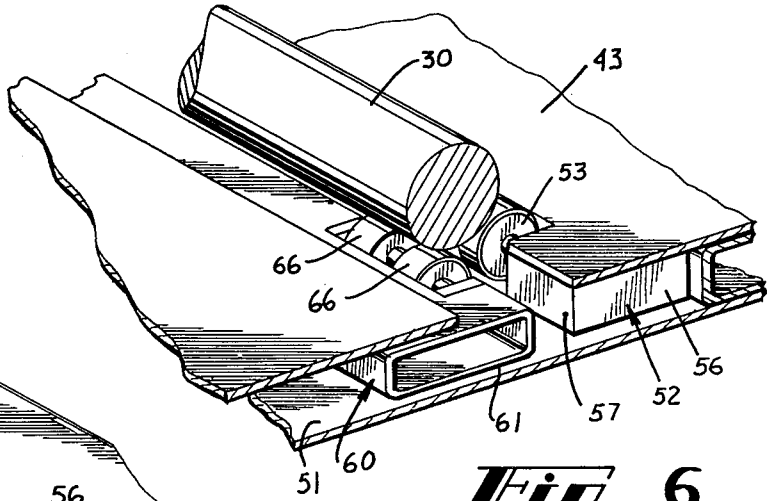
FIG. 6 is a perspective view of the portion of the apparatus in FIG. 7 and showing the cradle roll in a work position.
Figure 5:
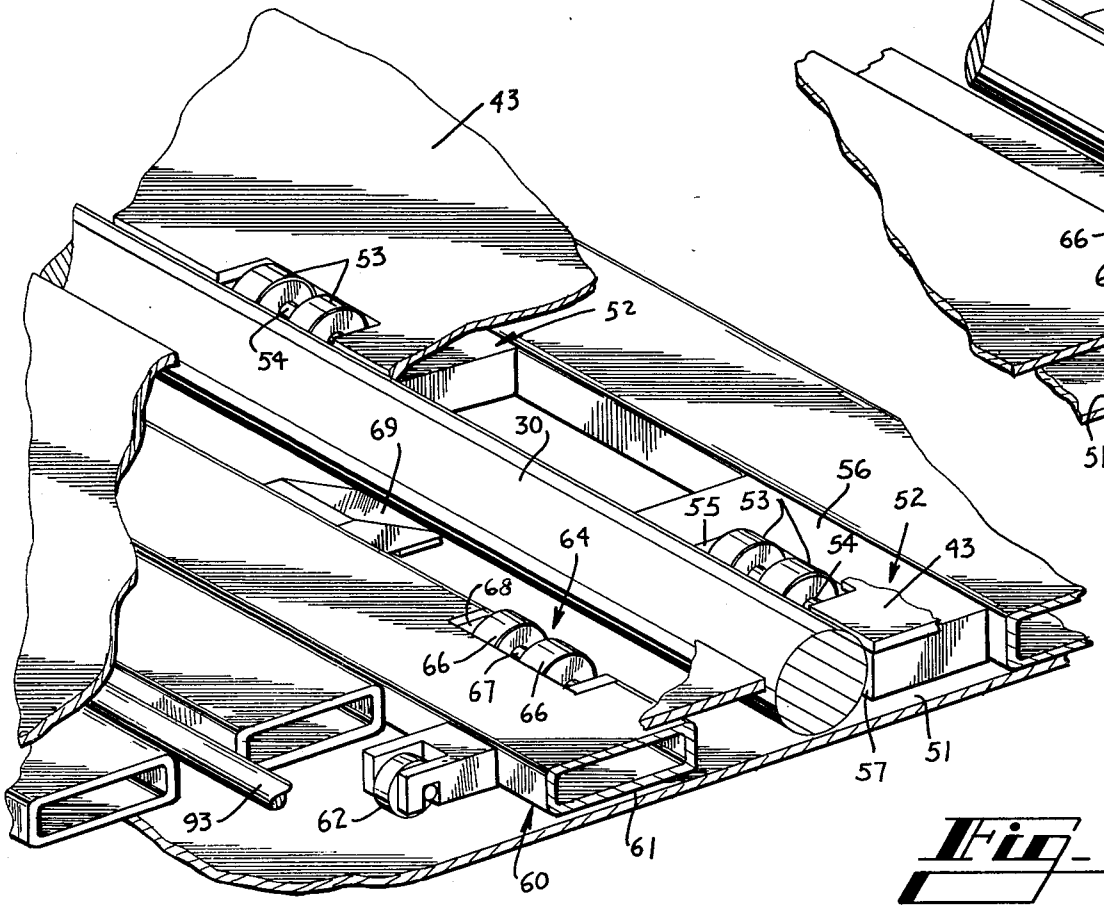
FIG. 5 is a perspective view of a portion of the apparatus and showing one of the cradle rolls in a rest position.

Viewing now FIGS. 2-3 and 5, the apparatus 20 is shown with the cover 41 removed from the base 21 and with top plates 46 and 47 removed from the housings 22 and 23, respectively, to expose the drive systems which are used to cause the reel 27 to be supported and turned in a work position above the floor level. Since the cradle rolls 30 and 31 within the base 21 in the preferred embodiment are substantialy identical in their construction and in their mounting, only the roll 30 will be described. The roll 30 extends between the housings 22 and 23 and is supported in engagement with a base plate 51. Each of the cradle rolls 30 and 31 is such that it generally extends between a first surface which is the top of the base plate 51 and a second or reference surface which is generally the top of the plate 43.

The roller 30 in an unoperated, rest position is also in engagement with a plurality of passive roller bearings 52—52, each of which includes a pair of spaced rollers 53—53 which are mounted rotatably on a rod 54 within a recess 55 within a bearing block 56 that is attached to the base plate 51. As can be seen in FIG. 3 in which the cradle roll 30 is shown in an unoperated position, the rollers 53—53 are mounted in the bearing blocks 56—56 so that they do not touch the base plate 51. Further, the rod 54 is mounted within the recess 55 so that the rollers 53—53 are set back and spaced a slight distance, e.g. about 0.16 cm, from a face 57 of the bearing block 56 (see FIG. 3). In a preferred embodiment, four roller bearings 52—52 are used with end ones being adjacent the housings 22 and 23.

Associated with each of the cradle rolls is an actuating member, designated generally by the numeral 60 and 60′ (see FIGS. 3-7), for causing the associated cradle roll to be moved from an unoperated to an operated position. Each of the actuating devices 60-60′ includes a beam 61 that spans between the housings 22 and 23 and that is supported generally in engagement with the base plate 51.

In order to facilitate the movement of the actuating member 60 from its unoperated position toward its associated cradle roll, a plurality of single rollers 62—62 are supported rotatably from a side of the beam 61 which is opposite the side that faces the cradle roll. The rollers 62—62 are mounted so that they engage the base plate 51 to hold the adjacent side of the beam 61 spaced slightly above the base plate.

On the side of the beam 61 which is adjacent the cradle roll 30, there are four active roller bearings 64—64. Each of the bearings 64—64 includes a pair of rollers 66—66 mounted rotatably on and spaced along a rod 67 that is supported within a recess 68 in the beam 61. As can best be seen in FIG. 3, the rollers 66—66 are mounted so that the lowermost portion of each is spaced slightly above the base plate 51. From FIG. 2, it can be seen that each of the roller bearings 64—64 is aligned with an associated one of the passive roller bearings 52—52 with the rollers 53—53 of each of the passive bearings being aligned with the rolls 66—66 of the associated active bearing. This avoids undue stresses being imparted to the cradle roll 30 when it is supported between associated roller bearings 52 and 66, particularly when a reel 27 of cable is supported by the cradle rolls.

The description of the actuating member 60 is completed by referring now to a plurality of wedges 69—69 (see FIGS. 2-3 and 5) which are attached to and spaced along the cradle roll side of the beam 61. The wedges 69—69 are spaced slightly above the base plate 51 and have a wedging portion 71 extending from the beam 61 between the cradle roll 30 and the base plate (see FIG. 5) when the actuating member is in an unoperated position. A pad 72, which is made of a low friction material such as nylon, for example, is attached to the underside of each wedge 69 in engagement with the base plate 51 to facilitate the sliding movement of the actuating member 60 along the base plate.

Figure 8:
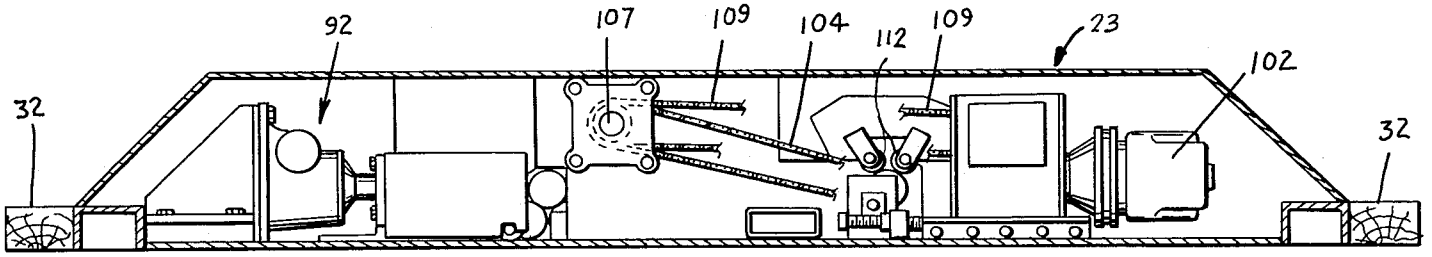
FIG. 8 is a side elevation view of the apparatus taken along lines 8—8 in FIG. 2 to show portions of the apparatus which are used to move the reel upwardly and portions which are used to rotate the reel.
Figure 7:
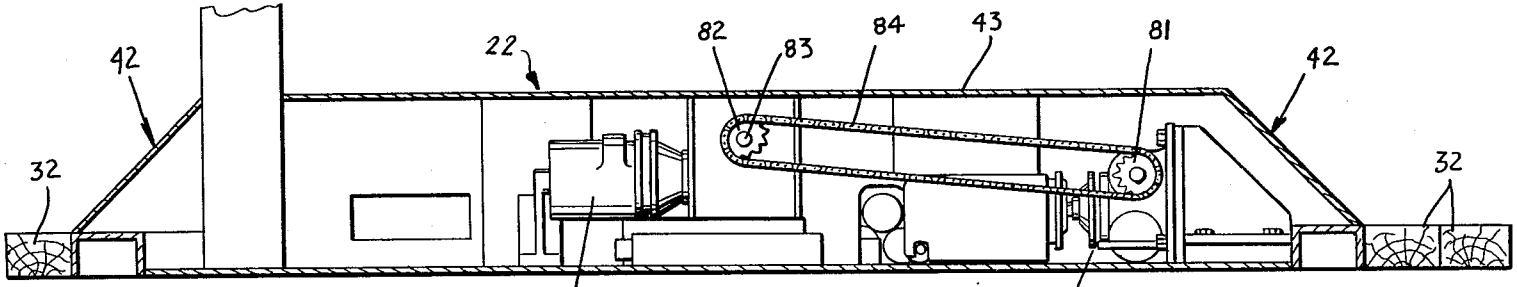
FIG. 7 is a side elevational view taken along lines 7—7 in FIG. 2 to show portions of the apparatus which are used to move the reel upwardly.

Referring now to FIGS. 2 and 7-8, there are shown facilities, which when operated through controls on the pedestal 24 (see FIG. 1), cause the actuating members 60-60′ associated with the cradle rolls 30 and 31 to elevate the cradle rolls from rest positions and any cable reel supported thereon into a work position. An air motor 81, such as one available commercially from Boston Pneumatic Air Motor Company under the designation No. 7022AXL, is mounted within the housing 22 and has a shaft 82 extending therefrom with a pulley 83. A chain 84 passes around the pulley 83 and around a pulley 86 mounted on a shaft 87 that extends through a screw and jack device 88 such as one available commercially from Duff-Norton under the designation No. 1805. The screw and jack device 88 is arranged so that a turning of the pulley 86 turns a worm gear (not shown) which causes a screw shaft 89 to be extended out of the device and to the left as shown in FIG. 7 to move a strap 91 that is attached to the actuator member 60 that is associated with the cradle roll 30.

In order to avoid a twisting of the beam 61 under load when moved by the device 88, a second screw and jack device 92 is mounted on the opposite side of the apparatus 20 within the housing 23. A drive train from the chain 84 and pulley 86 to the second device 92 includes a shaft 93 that extends between the housings 22 and 23 and is mounted rotatably in bearings 94—94 that are supported on the base plate 51. A strap 96 connects a screw shaft 97 of the device 92 to the actuator member 60 which together with the strap 91 prevents any non-uniform stresses from being imparted to the actuating member 60 when it is moved.

As can further be seen in FIG. 2, the straps 91 and 96 are also connected through rods 98 and 99 within the housings 22 and 23 to the actuating member 60' that is associated with the cradle roll 31.

Although in a preferred embodiment of the apparatus 20, only the cradle roll 31 is driven, it is within the scope of this invention that both cradle rolls or only the cradle roll 30 be driven. The driving of the cradle roll 31 is accomplished with a drive system, designated generally by the numeral 101, and mounted within the housing 23 as shown in FIG. 2. Referring now to FIGS. 2 and 8, it can be seen that the drive system 101 includes an air motor 102, such as one available commercially from Boston Pneumatic Air Motor Company under the designation No. 70722AXL having a pulley 103 with a chain 104 passing therearound to a second pulley 106 mounted on a shaft 107. Also mounted on the shaft 107 is a second pulley 108 having a chain 109 passing therearound to a pulley 111 mounted on end of the cradle roll 31. It should be observed that this arrangement effectively provides for an arcuate movement of the pulley 111 with the cradle roll 31 when that roll is elevated to a work position. In order to maintain the driven roller 31 in engagement with its satellite rollers 53—53 and 66—66, a pair of retention rollers 112—112 (see FIG. 8) are mounted within the housings 22 and 23 and are adapted to engage each end of the driven cradle roll when it has been moved into its work position.

In using the apparatus 20, a workperson causes a reel 27 of cable to be rolled along the factory floor 32 and onto the base 21 so that its flanges engage the base plate between the cradle rolls 30 and 31 (see FIG. 1). Then the workperson operates the control console 24 to cause the air motor 81 to be operated to turn the pulley 83 and chain 84. This causes the pulley 86 to be turned which moves the screw shaft 89 of the screw and jack arrangement 88 and through the shaft 93 causes the screw shaft 97 of the screw jack arrangement 92 to be moved. As the screw shafts 89 and 99 are moved to the left and right as viewed in FIG. 7 and FIG. 8, respectively, the strap plates 91 and 96 are moved which causes the actuating member 60 as well as the actuating member 60' associated with the cradle roll 31 to be moved. The wedges 69—69 attached to each of the actuating members 60—60 to be moved further toward the associated cradle rolls 30 and 31 which causes the cradle rolls to be cammed upwardly along the vertical surfaces 57—57 and along the inclined surfaces of the wedges, and then the curved surfaces of the passive and active satellite rollers 53—53 and 66—66, respectively, until each cradle roll is supported in engagement with its associated passive and active satellite rolls (see FIGS. 4 and 6).

The console 24 is then operated to control the air motor 101 to turn the chain 104, pulley 107, the pulley 108 and the chain 109 to cause the cradle roll 31 to be turned rotatably as it is supported by its passive and active satellite rolls 53—53 and 66—66, respectively. The turning is discontinued when a cable end is rendered accessible so that it can be connectorized with a connector such as that shown, for example, in U.S. Pat. No. 3,858,158. Later the reel 27 may be further turned to expose the other end of the length of cable after which the air motor 81 is operated in a reverse direction to turn the pulley 86 and shaft 93 in a counterdirection and cause a retraction of the screw shafts. This causes the actuating members 60–60' to be moved to the right as viewed in FIG. 7 which withdraws the active rolls and permits the cradle rolls 30 and 31 to descend along the wedges 69—69 and the curved surfaces of the passive rolls until the cradle rolls are supported in engagement with the base plate 51 in their rest positions (see FIGS. 3 and 5). This return of the cradle rolls 30 and 31 to their rest positions causes the reel 27 to descend into engagement with the base 51 so that it can be moved from the apparatus 20, and, if desired, in the same direction in which it was moved into the apparatus.

It should be apparent that modifications of the above-described, preferred apparatus may be made and yet be within the scope of this invention. What is realized by the apparatus of this invention is one which in a significantly minimum height is capable of supporting a reel for rotation and for rotating that reel. One alternative would be to support the apparatus 20 on the factory floor where with only slightly more effort, a reel 27 could be moved onto its reference surface which would be only several inches above the factory floor and then be raised into a work position where it could be rotated. Such a use may be contemplated for a takeup on a jacketing line, for example.

Figure 9:
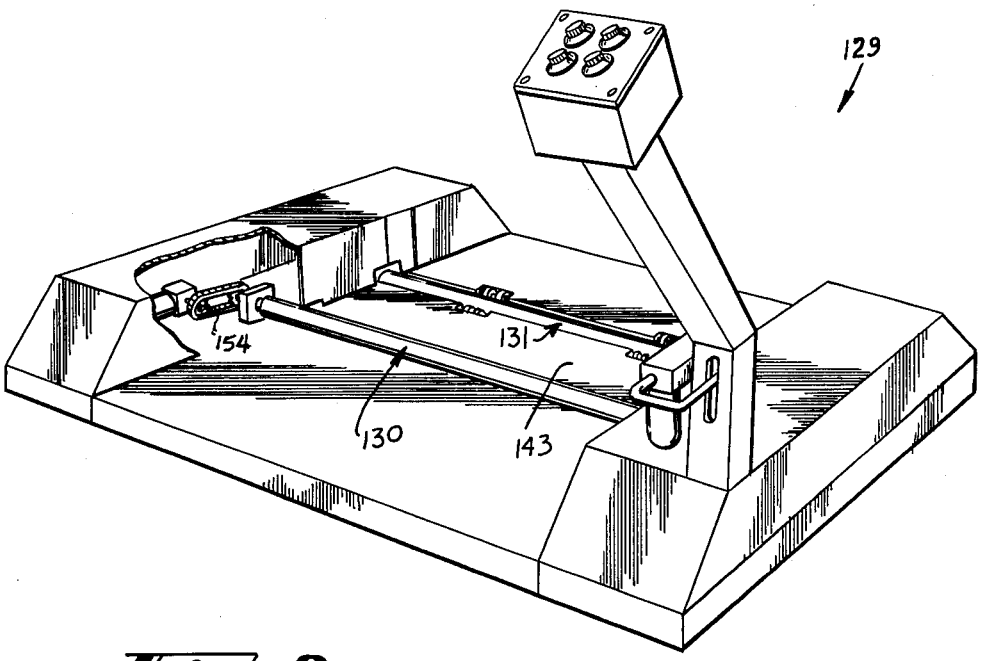
FIG. 9 is a perspective view of an alternative embodiment of the apparatus in accordance with the invention.
Figure 10:
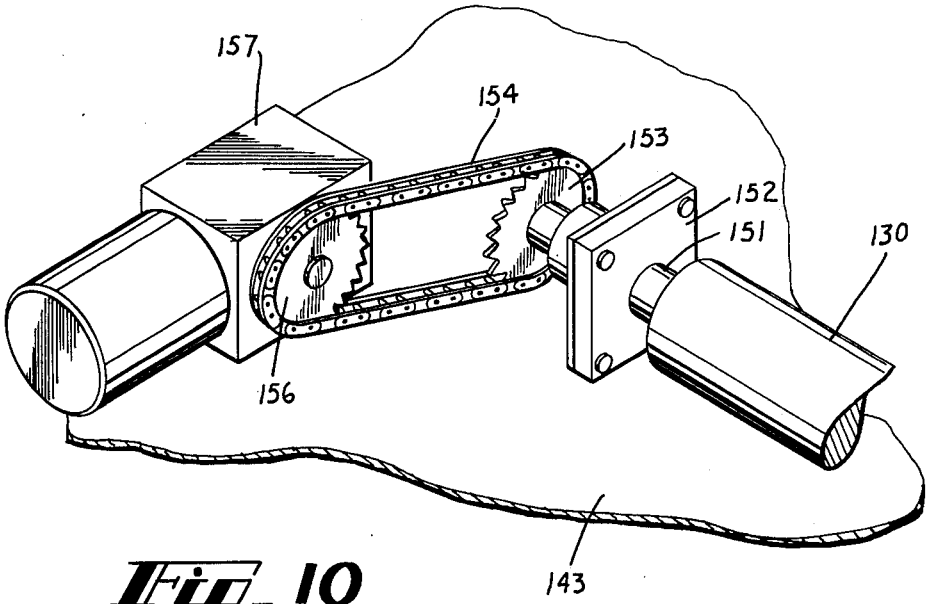
FIG. 10 is a perspective view partially in section of the alternative embodiment of the apparatus shown in FIG. 9.

In still another embodiment as shown in FIGS. 9 and 10, an apparatus, designated generally by the numeral 129, includes a pair of spaced cradle rolls 130 and 131. The cradle roll 130 is mounted at its ends for rotation in a position where at least a portion of it is above a plate 143 and hence above the factory floor. The cradle roll 131 in this embodiment is arranged as is the cradle roll 31 in the preferred embodiment and is mounted for movement from a rest position upwardly into engagement with a reel 27. In use, a reel 27 of cable, for example, is rolled on its flanges along the factory floor onto the plate 143 until its flanges engage the cradle roll 130. Then an actuating member (not shown) is operated to cause the cradle roll 131 to be moved upwardly as before until it engages the flanges of the reel 27 and then further upwardly until it is supported between its associated satellite active and passive rollers as was each of the cradle rolls 30 and 31 in the preferred embodiment. At that time, the reel 27 is supported for rotation between the cradle rolls 130 and 131.

As can best be seen in FIG. 10, the roll 130 has an end 151 extending through a bearing block 152 with a sprocket 153 mounted thereon. A chain drive 154 is passed around the sprocket 153 back to a drive sprocket 156 which is driven by a motor 157. The motor 157 is controlled to turn the chain 154 and the roll 130 to turn the reel 27. Once the work on the cable has been completed and the reel 27 returned to a position in engagement with a base plate, similar to the base plate 51, by operating the actuating member (not shown) to permit descent of the roll 131, the reel must be moved in a direction opposite to that in which it was moved onto the apparatus. As will be recalled, the reel 27 in the preferred embodiment can be moved through the apparatus 20 at the conclusion of the work operation.

In the preferred embodiment, wedges 69—69 are attached to the actuating members 60–60' to cause the cradle rolls 30 and 31 to be moved upwardly; however, it is within the scope of this invention to use elevating members such as scoop-like members (not shown) having curved surfaces to move between the cradle rolls and the base plate 31. Smaller rollers each having a diameter less than half the diameter of the passive rollers 53—53 (not shown) may be attached to the actuating members 60—60 instead of the wedges 69—69. A still further alternative would include the use of wedges attached to the bearing blocks 52—52 and projecting toward but misaligned with the wedges 69—69 to cause the cradle rolls to be moved upwardly.

Also, while in the preferred embodiment the wedges 69—69 are moved relative to the bearings 52—52, it is within the scope of this invention that the cradle rolls 30 and 31 are moved from rest to work positions by causing relative movement between the actuating members 60 and 60' and the associated bearings 52—52. For example, the wedges 69—69 may be stationary and the bearings 52—52 mounted on a member which spans transversely of the apparatus 20 and which is moveable to cause the bearings to be moved toward the wedges.

It is to be understood that the above-described arrangements are simply illustrative of the invention. Other arrangements may be devised by those skilled in the art which will embody the principles of the invention and fall within the spirit and scope thereof.

What is claimed is:

1. An apparatus for supporting a cylindrically shaped article for rotation, said apparatus comprising:

a pair of parallel rolls which are spaced apart a distance which is less than the diameter of an end section of a cylindrically shaped article to be supported thereon;

means for supporting at least one of said rolls in a rest position between a first surface and a second surface;

means for supporting the cylindrically shaped article in engagement with said second surface between said rolls;

means for causing said at least one roll to be moved from said rest position into engagement with said cylindrical article and then to be further moved into a work position to cause said article to be supported by said rolls above said second surface, said means including means moveable along said first surface for engaging said at least one roll at successively increasing distances above the first surface; and means effective when said at least one roll has been moved into said work position for supporting said at least one roll for rotation to facilitate rotation of said article.

2. The apparatus of claim 1, wherein said first and second surfaces are spaced apart a distance which is substantially equal to the diameter of said at least one roll.

3. An apparatus for turning a reel having two spaced flanges connected by a hub which includes the apparatus of claim 1, and which also includes means connected to at least one of said rolls for turning said roll to cause said reel to rotate about an axis which extends between said flanges and through said hub.

4. An apparatus for supporting a reel for rotation, said apparatus comprising:

a base which includes a support surface;

a pair of spaced, parallel cradle rolls which in a rest position are in engagement with said support surface;

a first plurality of rollers associated with each said cradle roll and mounted for rotation about fixed axes in at least proximate engagement with each of said cradle rolls;

an actuating member which is associated with each of said cradle rolls and which is adapted to be moved along said support surface from an unoperated to an operated position to cause said each of said cradle rolls to be moved from said rest position to a work position;

a second plurality of rollers associated with each said cradle roll which are mounted rotatably on said actuating member and which together with said first plurality of rollers support rotatably said cradle rolls in said work positions;

a plurality of wedges which are associated with one of said pluralities of rollers and which are adapted to extend between the associated cradle roll and said support surface to cause said associated cradle roll to be cammed upwardly along inclined surfaces of the wedges and then along the curved surfaces of the first and second pluralities of rollers into said work position; and means for moving said actuating member along said support surface from said unoperated to said operated position to cause relative motion between said wedges and the other plurality of rollers to extend the wedges between said support surface and the cradle rolls.

5. An apparatus for supporting a reel for rotation, said apparatus comprising:

a support surface;

a first cradle roll which in a rest position is in engagement with said support surface;

a second cradle roll spaced from and parallel to the first cradle roll and which in a rest position is in engagement with said support surface;

a plurality of passive rollers associated with each said cradle roll and mounted for rotation about fixed axes in at least proximate engagement with each of said cradle rolls;

an actuating member which is associated with each of said cradle rolls and which is adapted to be moved from an unoperated position to an operated position to cause each of said cradle rolls to be moved from said rest position to a work position, said actuating member comprising:

a plurality of active rollers which are mounted rotatably on said actuating member and which together with said passive rollers support rotatably said cradle rolls in said work position;

a plurality of wedges which are adapted to be moved between each said cradle roll and said support surface to cause said associated cradle roll to be cammed upwardly along inclined surfaces of the wedges and then along the curved surfaces of the passive and of the active rollers into said work position; and means for moving said actuating members from an unoperated to an operated position.

6. The apparatus of claim 5, which also includes means for supporting said reel in an initial position on a reference surface between said cradle rolls, and wherein the cradle rolls each have a diameter which is substantially equal to the distance between said support surface and the reference surface on which said reel to be turned is initially supported, the movement of the cradle rolls to a work position causing said reel to be supported rotatably above said reference surface.

7. The apparatus of claim 5, wherein the support surface includes a plate and said wedges have a pad of low friction material which engages said plate to facilitate the movement of the wedges therealong.

8. The apparatus of claim 5, wherein the passive rollers are mounted in recesses in bearing blocks that are in engagement with said support surface, said rollers being mounted within said recesses in said bearing blocks so that they are spaced a slight distance from a vertical surface of each said block and having a substantial portion projecting above a top surface of each said block, said movement of each said actuating member from the unoperated to the operated position being effective to cause each said cradle roll to be moved upwardly in engagement with said vertical surfaces of the bearing blocks as they are moved along the inclined surface of the wedges and then along the curved surfaces of the passive and active rollers.

9. The apparatus of claim 5, wherein each of said actuating members includes a plurality of secondary rollers which are mounted rotatably on a side of said actuating member which is opposite to the side on which said active rollers are mounted, said secondary rollers being effective to facilitate said movement of said actuating members along said support surface from the unoperated to the operated position.

10. An apparatus for supporting a reel for rotation and for turning said reel, said apparatus comprising:

a support surface;

a reference surface for initially supporting said reel;

a first cradle roll which when in a rest position is in engagement with said support surface and which has a diameter which is substantially equal to the distance between said support surface and said reference surface;

a second cradle roll spaced from and parallel to said first cradle roll;

means for supporting rotatably said second cradle roll in a position with at least a portion of said second roll protruding above said reference surface;

a plurality of passive rollers mounted for rotation about fixed axes and in engagement with said first cradle roll;

an actuating member associated with said first cradle roll which when moved from an unoperated position to an operated position causes said first cradle roll to be moved from a rest to a work position, said actuating member comprising:

a plurality of active rollers which are mounted rotatably on said actuating member which together with said passive rollers support said cradle roll in said work position;

a plurality of wedges which are adapted to be moved between said first cradle roll and said support surface to cause said cradle roll to be cammed upwardly along inclined surfaces of the wedges and curved surfaces of the passive and the active rollers into said work position; and means for moving said actuating member from an unoperated to an operated position to cause said wedges to move said first cradle roll to said work position and to cause said reel to be supported for rotation between said two cradle rolls; and means for turning rotatably at least one of said cradle rolls to turn said reel about an axis extending through a hub of the reel and being parallel to longitudinal axes of said cradle rolls.

* * * * *